US011264707B2

(12) United States Patent
Prabhakar

(10) Patent No.: US 11,264,707 B2
(45) Date of Patent: Mar. 1, 2022

(54) ANTENNA APPARATUS AND RELATED COMMUNICATION SYSTEMS FOR USE WITH VEHICLE LAMPS

(71) Applicant: TOYOTA MOTOR ENGINEERING & MANUFACTURING NORTH AMERICA, INC., Plano, TX (US)

(72) Inventor: Varun J. Prabhakar, Saline, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 12 days.

(21) Appl. No.: 16/689,624

(22) Filed: Nov. 20, 2019

(65) Prior Publication Data

US 2021/0151867 A1 May 20, 2021

(51) Int. Cl.
*H01Q 1/32* (2006.01)
*H01Q 1/36* (2006.01)

(52) U.S. Cl.
CPC ..... *H01Q 1/3291* (2013.01); *H01Q 1/36* (2013.01)

(58) Field of Classification Search
CPC ..... H01Q 1/3233; H01Q 1/38; H01Q 21/065; H01Q 1/3275; H01Q 1/1271; H01Q 1/42; H01Q 9/0407; H01Q 9/0428; H01Q 21/0075; H01Q 1/3283; H01Q 1/3291; H01Q 21/28; H01Q 9/30; G01S 13/931; G01S 13/003; G01S 2013/93277; G01S 7/415; G01S 13/56; G01S 17/931; G01S 5/0252; G01S 5/14; G01S 7/006; G01S 5/0294
USPC ..... 343/712, 702, 711, 713, 714; 362/465, 362/460, 524, 538
See application file for complete search history.

(56) References Cited

U.S. PATENT DOCUMENTS

| | | | | |
|---|---|---|---|---|
| 6,446,998 | B1 | 9/2002 | Koenig et al. | |
| 6,459,476 | B2 | 10/2002 | Nishimura | |
| 7,142,098 | B2 | 11/2006 | Lang et al. | |
| 9,834,133 | B2 | 12/2017 | Bean | |
| 9,981,667 | B2 | 5/2018 | Hoare et al. | |
| 2004/0012973 | A1* | 1/2004 | Baker | G01S 7/03 362/464 |
| 2004/0217906 | A1* | 11/2004 | Ishibayashi | H01Q 1/1271 343/713 |

(Continued)

FOREIGN PATENT DOCUMENTS

JP 2013-234800 A 11/2013

*Primary Examiner* — Linh V Nguyen
(74) *Attorney, Agent, or Firm* — Oblon, McClelland, Maier & Neustadt, L.L.P.

(57) ABSTRACT

Antenna apparatus and related communication systems for use with vehicle lamps are disclosed. A disclosed communication system for a vehicle and a trailer includes a lamp positioned on the vehicle and a conductive structure coupled to a stylized component of the lamp. The communication system also includes a primary antenna at least partially formed by the conductive structure and electrically coupled to a vehicle electronic device. The communication system also includes a secondary antenna positioned on the trailer and electrically coupled to a trailer electronic device. The primary and secondary antennas, together, are configured to interact with each other to provide wireless communication between the vehicle and trailer electronic devices.

16 Claims, 9 Drawing Sheets

(56) References Cited

U.S. PATENT DOCUMENTS

| | | | | |
|---|---|---|---|---|
| 2005/0258947 | A1* | 11/2005 | Kunianski | B60D 1/62 340/431 |
| 2007/0241962 | A1* | 10/2007 | Shinoda | H01Q 15/24 342/361 |
| 2008/0111750 | A1* | 5/2008 | Yoshie | H01Q 1/3275 343/713 |
| 2008/0158045 | A1* | 7/2008 | Teranishi | G01S 13/931 342/70 |
| 2008/0158897 | A1* | 7/2008 | Nakamura | G01S 17/931 362/487 |
| 2016/0064806 | A1* | 3/2016 | Geary | H01Q 21/065 343/713 |
| 2016/0365644 | A1* | 12/2016 | Finn | H01Q 7/00 |
| 2017/0297391 | A1* | 10/2017 | Pilliod | B60D 1/62 |
| 2017/0301981 | A1* | 10/2017 | Niihara | H01Q 1/38 |
| 2019/0007597 | A1* | 1/2019 | Cordeiro | H04N 5/23203 |
| 2019/0084477 | A1 | 3/2019 | Gomez-Mendoza et al. | |
| 2019/0089042 | A1* | 3/2019 | Purden | H01Q 1/3283 |

* cited by examiner

ANTENNA APPARATUS AND RELATED COMMUNICATION SYSTEMS FOR USE WITH VEHICLE LAMPS

FIELD OF THE DISCLOSURE

This disclosure relates generally to vehicles and, more particularly, to antenna apparatus and related communication systems for use with vehicle lamps.

BACKGROUND

Motor vehicles typically employ wireless communication systems to allow different electronic devices to communicate with each other. For example, in certain applications where a vehicle is towing a trailer, the vehicle may include an electronic display that is positioned in a cabin of the vehicle to present visual information to a vehicle occupant. Sometimes, such an electronic display is configured to wirelessly communicate (e.g., via radio frequency) with a wireless trailer device (e.g., a camera) positioned on the trailer, for example, to generate images, video, etc. depicting surroundings of the trailer for viewing by the driver, which can assist the driver in maneuvering the vehicle and/or the trailer.

Additionally, motor vehicles also typically employ lighting devices to provide both interior and exterior illumination. Some exterior vehicle lamps (e.g., headlamps, tail lamps, etc.) may include components that are particularly shaped, formed, and/or structured such as housings, lenses, reflectors, bezels, trim, etc. Often, drivers or vehicle owners desire customized aesthetic features and/or visual designs for such lamp components. For example, some bezels are metallized with chrome.

SUMMARY

An example communication system for a vehicle and a trailer includes a lamp positioned on the vehicle and a conductive structure coupled to a stylized component of the lamp. The communication system also includes a primary antenna at least partially formed by the conductive structure and electrically coupled to a vehicle electronic device. The communication system also includes a secondary antenna positioned on the trailer and electrically coupled to a trailer electronic device. The primary and secondary antennas, together, are configured to interact with each other to provide wireless communication between the vehicle and trailer electronic devices.

An example vehicle lamp includes a housing. The vehicle lamp also includes a stylized component supported by the housing and including a metallic layer that covers a substrate of the stylized component. The vehicle lamp also includes a primary antenna supported by the housing and electrically coupled to a vehicle electronic device and the metallic layer. The primary antenna is configured to electromagnetically interact with a secondary antenna external to the vehicle lamp. The metallic layer is configured to adjust an operating parameter of the primary antenna during a wireless communication process associated with the vehicle electronic device.

An example method of providing an antenna for a vehicle electronic device includes forming a stylized component of a vehicle lamp. The method also includes coupling a metallic layer to a substrate of the stylized component. The method also includes mounting the antenna on a portion of the vehicle lamp. The method also includes electrically coupling the metallic layer to the antenna such that the metallic layer adjusts an operating parameter of the antenna during a wireless communication process associated with the vehicle electronic device.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

In general, the same reference numbers will be used throughout the drawing(s) and accompanying written description to refer to the same or like parts.

DETAILED DESCRIPTION

Figure 1:
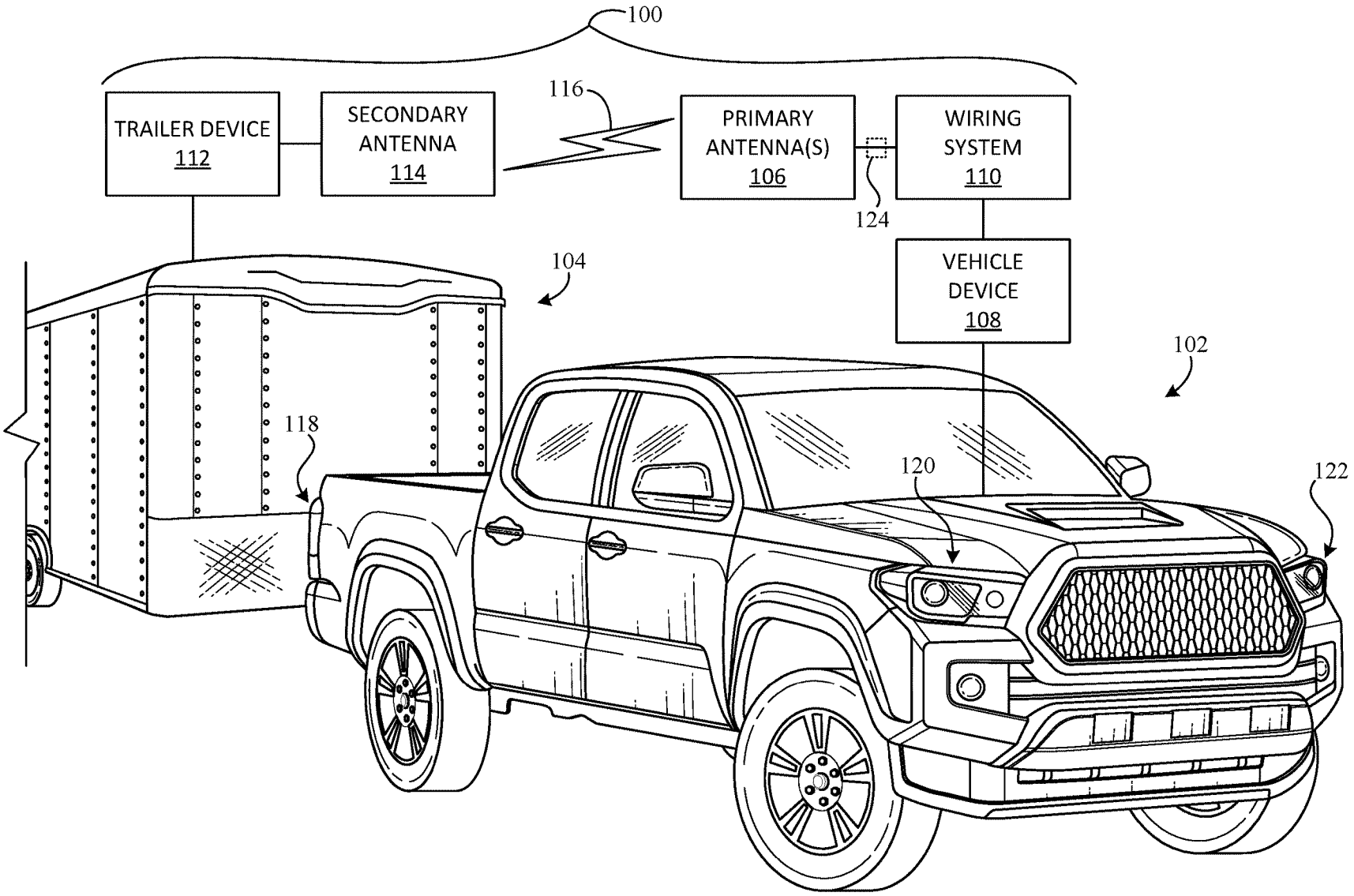
FIG. 1 is a view of an example communication system for an example vehicle and an example trailer in accordance with the teachings of this disclosure.

Some vehicles are provided with a vehicle-mounted electronic device that is connected to a known vehicle antenna such as a Wi-Fi antenna. The known vehicle antenna is configured to electromagnetically interact with a trailer antenna of a wireless trailer-mounted electronic device, which allows the two electronic devices to communicate with each other via wireless signals transmitted between vehicle and trailer antennas. Such known vehicle antennas are typically mounted on a vehicle roof and sometimes referred to as shark-fin antennas. However, these known vehicle antennas have limited range and, depending on a location of the trailer-mounted electronic device relative to a trailer, may not sufficiently maintain wireless transmission of data between the two electronic devices. For example, when a trailer camera is mounted on a back door of the trailer, electromagnetic waves generated by the trailer antenna need to travel through many surfaces and planes of material before reaching one of these known vehicle antennas, which is not ideal for wireless communication. Additionally, for trucks, a bed length adds substantial distance between such a roof-mounted vehicle antenna and a trailer-mounted electronic device.

Antenna apparatus and related communication systems for use with vehicle lamps are disclosed. Examples disclosed herein provide an example wireless communication system for a vehicle (e.g., a tow vehicle) and a trailer operatively coupled to or towed by the vehicle. The disclosed communication system includes an example vehicle lamp (e.g., one of a rear combination lamp (RCL), a back door mounted rear lamp (RRL), etc.) and an example primary antenna (e.g., a Wi-Fi antenna.) that is mounted on the vehicle lamp. The disclosed communication system also includes a vehicle electronic device (e.g., a display, an electronic control unit (ECU), etc.) that is electrically coupled (e.g., via a wiring system of the vehicle) to the primary antenna and configured to wirelessly communicate, via the primary antenna, with an electronic device external to the vehicle such as, for example, an example trailer electronic device (e.g., wireless trailer-mounted device) such as one of a trailer camera, a device of a trailer tire pressure monitoring system (TPMS), etc. For example, the disclosed primary antenna is configured to electromagnetically interact with an example secondary antenna (e.g., a Wi-Fi antenna) mounted on the trailer and electrically coupled to the trailer electronic device, thereby enabling wireless transmission of data between the vehicle and trailer electronic devices. In particular, the primary antenna is advantageously integrated into the disclosed vehicle lamp, as will be discussed in greater detail below. As a result of such integration, disclosed examples provide a cost effective and/or efficient packaging solution for a vehicle lamp and antenna. Additionally, disclosed examples advantageously utilize one or more example stylized components of the disclosed vehicle lamp to enhance performance of the primary antenna and/or better maintain the wireless transmission of data between the vehicle and trailer devices compared to the above-mentioned known vehicle antennas.

In some examples, the disclosed vehicle lamp is a tail lamp that is positioned rearward in the vehicle adjacent the trailer and has good visibility to a rear of the vehicle. In such examples, by positioning the primary antenna at a location (e.g., a rearmost corner) of the vehicle defined by the vehicle lamp, disclosed examples reduce (e.g., minimize) a distance between the primary and secondary antennas as well as increase (e.g., maximize) signal range associated with the vehicle electronic device. Additionally, some examples provide at least two example primary antennas, each of which is electrically coupled to the vehicle electronic device and positioned at respective rearmost corners of the vehicle. That is, in such examples, each of the disclosed primary antennas is coupled to a tail lamp of the vehicle. Such disclosed examples improve signal coverage and/or reduce a likelihood that an obstruction will interfere with the wireless transmission of data between the vehicle and trailer electronic devices. In particular, by placing a disclosed primary antenna at each tail lamp of the vehicle, disclosed examples provides a substantially wide field-of-view (FOV) of wireless reception associated with the primary antenna, which effectively compensates for trailer articulation angles. For example, as the trailer moves relative to the vehicle based on a steering angle of the vehicle, the trailer electronic device and/or the secondary antenna travel across a path (e.g., an arc-shaped path) while remaining in the FOV.

The disclosed vehicle lamp includes an example stylized component such as, for example, one of a lens, a bezel, trim, etc. In some examples, the primary antenna is embedded in a portion of the disclosed stylized component. On the other hand, in some examples, the primary antenna is external to a housing of the vehicle lamp. In such examples, the primary antenna is electrically coupled to example antenna circuitry (e.g., a circuitry package associated with operation of an antenna) positioned in the housing. Additionally, some disclosed examples provide an example conductive structure (e.g., an antenna element) that is coupled to a substrate (e.g., a plastic layer) of the stylized component, for example, via one or more metallization processes. In some examples, the disclosed conductive structure includes one or more conductive traces at least partially covering the substrate, one or more metal plates at least partially covering the substrate, etc., and/or any other suitable metallic layer(s). As such, the substrate of the disclosed stylized component includes one or more metallized surfaces that are produced, for example, via one or more metallization processes. In such examples, the disclosed primary antenna is electrically coupled to the conductive structure, which substantially enhances antenna performance. In particular, the conductive structure is sized, shaped, structured, and/or otherwise configured to improve one or more parameters (sometimes referred to as operating parameters) associated with operation of the primary antenna such as, for example, one or more (e.g., all) of a signal range, a gain, a beamwidth, an efficiency, etc. For example, the disclosed conductive structure causes the signal range associated with the primary antenna to increase during a wireless communication process associated with the vehicle electronic device.

Thus, the disclosed primary antenna is at least partially formed and/or defined by the disclosed conductive structure. That is, in some examples, the disclosed conductive structure is a substantially complete primary antenna of the communication system or at least an extension of the primary antenna. In any case, in response to the vehicle electronic device applying a first electric current (e.g., an alternating electric current indicative of encoded data) to the conductive structure, the conductive structure is configured to convert the first electric current into one or more outgoing or first wireless signals (i.e., electromagnetic waves) receivable by the secondary antenna. That is, based on the first electric current applied to the conductive structure, the conductive structure generates and/or emits the outgoing wireless signal(s) such that the outgoing wireless signal(s) travel away from the conductive structure and toward the secondary antenna. Additionally or alternatively, in some examples, in response to receiving one or more incoming or second wireless signals (i.e., electromagnetic waves) (e.g., generated by the secondary antenna), the disclosed conductive structure is configured to convert the incoming wireless signal(s) into a second electric current (e.g., an alternating electric current indicative of encoded data) for processing by the vehicle electronic device.

Additionally, in some examples, the disclosed conductive structure forms and/or defines an example metallization pattern (e.g., a zig-zag pattern, a hatching pattern, a honeycomb pattern, or a stripe pattern, etc.) exposing a transparent surface (e.g., an area of the substrate) of the stylized component. In such examples, light emitted from a light source of the vehicle lamp passes through the transparent surface and the conductive structure to provide a light pattern visible to a person external to the vehicle. In this manner, disclosed examples further enhance antenna perform and/or maintain sufficient light brightness associated with the vehicle lamp. Additionally or alternatively, the disclosed metallization pattern(s) serve as an aesthetic feature that may be desirable to a driver or vehicle owner.

Additionally, some disclosed examples also electrically integrate the disclosed primary antenna into the vehicle lamp. In particular, such disclosed examples provide an example connection interface such as, for example, a pin and socket interface, as discussed in greater detail below in connection with FIG. 6. In some examples, the disclosed connection interface includes a single wire harness electrically coupling the vehicle lamp and the primary antenna to a wiring system of the vehicle. In such examples, the disclosed primary antenna does not require a separate body opening or a wire pass through, which is typically associated with accommodating the above-mentioned known antennas. As a result, disclosed examples reduce costs and/or time typically associated with properly installing such antennas on a vehicle.

FIG. 1 is a view of an example communication system (e.g., a wireless communication system) 100 for an example vehicle 102 and an example trailer 104 in accordance with the teachings of this disclosure. The vehicle 102 of FIG. 1 is, for example, one of a truck, a sport utility vehicle (SUV), a van, a car, etc. in which examples disclosed herein can be implemented. Further, the trailer 104 of FIG. 1 is, for example, one of an enclosed trailer, a flatbed trailer, a utility trailer, etc. in which examples disclosed herein can be implemented. According to the illustrated example of FIG. 1, the communication system 100 includes one or more example primary antennas 106 and a first or vehicle electronic device 108 (sometimes referred to as a vehicle device) electrically coupled to the primary antenna(s) 106, for example, via an example wiring system 110 of the vehicle 102. The primary antenna(s) 106 and the vehicle electronic device 108 are positioned on and/or carried by the vehicle 102. Additionally, the communication system 100 of FIG. 1 also includes a second or trailer electronic device 112 (sometimes referred to as a trailer device) that is positioned on and/or carried by the trailer 104. In particular, the vehicle electronic device 108 is structured and/or configured to wirelessly communicate, via the primary antenna(s) 106, with the trailer electronic device 112.

In some examples, to facilitate wireless transmission of data between the vehicle and trailer devices 108, 112, the communication system 100 of FIG. 1 also includes an example secondary antenna 114 that is and carried by the trailer 104. The secondary antenna 114 of FIG. 1 is electrically coupled to the trailer electronic device 112, for example, via a signal or transmission wire extending from the secondary antenna 114 to the trailer electronic device 112. In some examples, the secondary antenna 114 of FIG. 1 is positioned on and/or integrated into a portion (e.g., a housing) of the trailer electronic device 112 such that the trailer device 112 and the secondary antenna 114 form and/or define as single-piece or integral component. In particular, the primary antenna(s) 106 and the secondary antenna 114, together, are configured to provide wireless communication between the vehicle electronic device 108 and the trailer electronic device 112 via a wireless communication link (e.g., radio frequency) 116. Each of the primary and secondary antennas 106, 114 of FIG. 1 can be implemented, for example, using (a) one or more Wi-Fi antennas, (b) one or more Long-Term Evolution (LTE) antennas, (c) one or more Global Positioning System (GPS) antennas, (d) etc., (e) any other suitable antenna, or (f) a combination thereof (e.g., some or all of (a), (b), (c), (d), and/or (e)). Each of the primary antenna(s) 106 is sometimes referred to as a vehicle antenna. Further, the secondary antenna 114 is sometimes referred to as a trailer antenna.

According to the illustrated example of FIG. 1, the communication system 100 also includes a first example vehicle lamp 118 in which examples disclosed herein can be implemented. The first lamp 118 of FIG. 1 is a tail lamp operatively coupled to the vehicle 102 such as, for example, an RCL or an RRL. In particular, one or more of the primary antenna(s) 106 of the communication system 100 are integrated into the first lamp 118 such that the primary antenna(s) 106 and the first lamp 118 form and/or define a single-piece or integral component, as will be discussed further below in connection with FIGS. 5-8. Additionally or alternatively, in some examples, one or more of the primary antenna(s) 106 of the communication system 100 are similarly implemented in one or more other lamp(s) of the vehicle 102 in addition or alternatively to the first lamp 118 of FIG. 1. As shown in FIG. 1, the vehicle 102 includes a second example lamp (e.g., a headlamp) 120 and a third example lamp (e.g., a headlamp) 122.

The first vehicle lamp 118 of FIG. 1 is configured to generate light and/or emit the light away from the vehicle 102, for example, to illuminate a driving surface (e.g., concrete, asphalt, dirt, etc.) and/or provide visual indication(s) to a driver or person. As such, the first vehicle lamp 118 is electrically coupled to a controller (e.g., an ECU) of the vehicle 102 to enable lighting functionality of the first vehicle lamp 118. In some examples, the first vehicle lamp 118 is electrically coupled to the vehicle electronic device 108 such that the vehicle electronic device 108 can control the first vehicle lamp 118. For example, the first vehicle lamp 118 receives one or more control signals or commands and/or electrical power from the vehicle electronic device 108, which causes the first vehicle lamp 118 to produce the light.

The vehicle electronic device 108 of FIG. 1 can be implemented, for example, using (a) an ECU, (b) an output device (e.g., a light-emitting diode (LED), an electronic display or screen, an electroacoustic transducer or loudspeaker, etc.), (c) etc., (d) any other suitable vehicle electronic device, or (e) a combination thereof (e.g., some or all of (a), (b), (c), and/or (d)). The vehicle electronic device 108 of FIG. 1 can be provided as a single, integrated device or multiple devices configured to function cooperatively. The vehicle electronic device 108 is coupled to a portion of the vehicle 102 such that the vehicle electronic device 108 is carried by the vehicle 102. In some examples, when the vehicle electronic device 108 includes the output device, the vehicle electronic device 108 is positioned in a cabin of the vehicle 102 near a vehicle occupant or driver. In such examples, based on data obtained from the trailer electronic device 112, the vehicle electronic device 108 is configured to 108 to generate visual data (e.g., one or more images, video, text, etc.) and/or audible data (e.g., a sound such as a chime, natural language speech, etc.) for the driver in the vehicle 102, which assists the driver in maneuvering the vehicle 102 and/or trailer 104 in certain driving conditions.

In some examples, the vehicle electronic device 108 of FIG. 1 includes one of a first receiver, a first transmitter, or a first transceiver that is electrically coupled to the primary antenna(s) 106 via the wiring system 110, which enables the vehicle electronic device 108 to obtain data from an electric current carried by the primary antenna(s) 106 and/or input data into the electric current. In such examples, the vehicle electronic device 108 is configured to encode, via the first transmitter or the first transceiver, machine-readable information or data into a first electric current (e.g., an alternating current) that the vehicle electronic device 108 applies to one or more (e.g., all) of the primary antenna(s) 106. Additionally or alternatively, in some examples, the vehicle electronic device 108 is configured to decode and/or extract, via the first receiver or the first transceiver, data from a second electric current (e.g., an alternating current indicative of machine-readable information or data provided by the trailer electronic device 112) induced in the primary antenna(s) 106 by one or more wireless signals received by the primary antenna(s) 106.

In some examples, the primary antenna(s) 106 are configured to generate one or more wireless signals (i.e., one or more electromagnetic waves) receivable by the secondary antenna 114 in response to the primary antenna(s) 106 receiving the first electric current from the vehicle electronic device 108. That is, each of the primary antenna(s) 106 of FIG. 1 is configured to convert the first electric current into the wireless signal(s). Such wireless signal(s) are emitted from the primary antenna(s) 106 and/or travel toward the secondary antenna 114. In such examples, the secondary antenna 114 is configured to receive the wireless signal(s) from the primary antenna(s) 106 and, in response, convert the wireless signal(s) into a third electric current (e.g., an alternating current indicative of the machine-readable information or data provided by the vehicle electronic device 108) for processing by the trailer device 112.

The wiring system 110 of FIG. 1 facilitates electrically interconnecting different electronic components of the vehicle 102. The wiring system 110 of FIG. 1 can be implemented, for example, using one or more transmission or signal wires, a bus (e.g., a vehicle controller area network (CAN) bus), etc. According to the illustrated example of FIG. 1, the wiring system 110 is electrically coupled between the primary antenna(s) 106 and the vehicle electronic device 108. Additionally, in some examples, the wiring system 110 is electrically coupled between one or more (e.g., all) of the lamps 118, 120, 122 of the vehicle 102 and lighting control circuitry of the vehicle 102. Additionally, in some examples, the wiring system 110 is electrically coupled to an electrical system of the trailer 104, which facilitates powering trailer-mounted electronic devices and/or lamps of the trailer 104.

The trailer device 112 of FIG. 1 can be implemented, for example, using (a) a sensor (e.g., a camera), (b) a device of a trailer TPMS, (c) an ECU, (d) etc., (e) any other suitable electronic device, or (f) a combination thereof. The trailer electronic device 112 of FIG. 1 can be provided as a single, integrated device or multiple devices configured to function cooperatively. The trailer electronic device 112 of FIG. 1 is coupled to a portion of the trailer 104 such that the trailer electronic device 112 is carried by the trailer 104. In some examples, when the trailer electronic device 112 includes the sensor, the trailer electronic device 112 is positioned on a back door of the trailer.

In some examples, the trailer electronic device 112 of FIG. 1 includes one of a second receiver, a second transmitter, or a second transceiver that is electrically coupled to the secondary antenna 114, which enables the trailer electronic device 112 to obtain data from an electric current carried by the secondary antenna 114 and/or input data into the electric current. In such examples, the trailer electronic device 112 is configured to encode, via the second transmitter or the second transceiver, machine-readable information or data (e.g., sensor data such as images) into a fourth electric current (e.g., an alternating current) that the trailer electronic device 112 applies to the secondary antenna 114. Additionally or alternatively, in some examples, the trailer electronic device 112 is configured to decode and/or extract, via the second receiver or the second transceiver, data from the third alternating current induced in the secondary antenna 114 by one or more wireless signals received by the secondary antenna 114.

In some examples, the secondary antenna 114 is configured to generate one or more wireless signals (i.e., one or more electromagnetic waves) receivable by one or more (e.g., all) of the primary antenna(s) 106 in response to the secondary antenna 114 receiving the fourth electric current. That is, the secondary antenna 114 of FIG. 1 is configured to convert the fourth electric current into the wireless signal(s). Such wireless signal(s) are emitted from the secondary antenna 114 and/or travel toward the primary antenna(s) 106. In such examples, one or more (e.g., all) of the primary antenna(s) 106 is/are configured to receive the wireless signal(s) from the secondary antenna 114 and, in response, convert the wireless signal(s) into the second electric current for processing by the vehicle device 108.

Additionally, in some examples, to facilitate installing the primary antenna(s) 106 on the vehicle 102, the communication system 100 of FIG. 1 also includes an example connection interface (e.g., a pin and socket interface) 124 operatively interposed between the primary antenna(s) 106 and the wiring system 110. In particular, the connection interface 124 of FIG. 1 is configured to connect (e.g., removably connect) the primary antenna(s) 106 to the wiring system 110, as discussed further below in connection with FIG. 6. Additionally, in some examples, the connection interface 124 is also configured to connect (e.g., removably connect) one or more of the vehicle lamps 118, 120, 122 to the wiring system 110.

Figure 2:
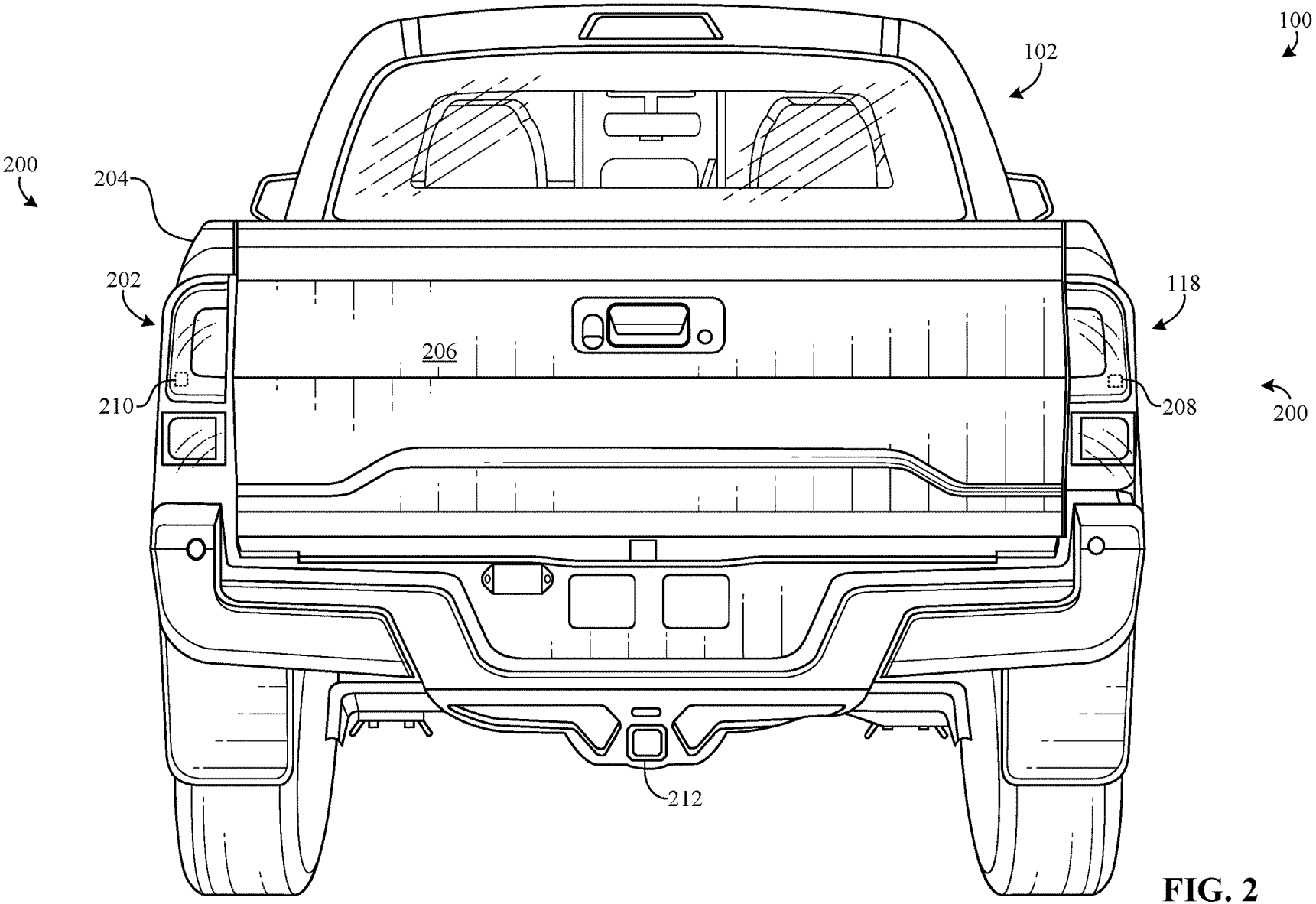
FIG. 2 is a rearview of the example vehicle of FIG. 1 and shows an antenna configuration in accordance with the teachings of this disclosure.

FIG. 2 is a rearview of the vehicle 102 of FIG. 1 and shows an example antenna configuration 200 in accordance with the teachings of this disclosure. According to the illustrated example of FIG. 2, the communication system 100 also includes a fourth example lamp (e.g., tail lamp such as an RCL or RRL) 202 of the vehicle 102 in which examples disclosed herein can be implemented. The fourth lamp 202 of FIG. 2 is operatively coupled to the vehicle 102. As shown in FIG. 2, each of the first lamp 118 and the fourth lamp 202 is positioned on a body 204 of the vehicle 102 adjacent a door or gate (e.g., a back door such as a tail gate) 206 of the vehicle 102. In particular, the communication system 100 also includes a first primary antenna 208 (i.e., a first one of the primary antenna(s) 106 of FIG. 1) mounted on a portion of the first lamp 118 and a second primary antenna 210 (i.e., a second one of the primary antenna(s) 106 of FIG. 1) mounted on a portion of the fourth lamp 202, which are represented by the dotted/dashed lines of FIG. 2. As such, the first and second primary antennas 208, 210 are positioned at corners (e.g., rearmost corners) of the vehicle 102 that are defined by the respective first and fourth lamps 118, 202.

In some examples, to facilitate towing the trailer 104, the vehicle 102 of FIG. 2 includes an example hitch 212 that is coupled to a support structure (e.g., a frame, a bed, etc.) of the vehicle 102. The hitch 212 of FIG. 2 can be implemented, for example, using a rear receiver hitch, a bumper hitch, a weight distribution hitch, a gooseneck hitch, a fifth wheel hitch, etc. According to the illustrated example of FIG. 2, the hitch 212 is coupled to a frame or chassis of the vehicle 102, for example, via one or more fasteners and/or one or more fastening methods or techniques. In particular, the hitch 212 of FIG. 2 is configured to couple (e.g., removably couple) to a receiver (e.g., a metal tube) having a mounting portion (e.g., a ball mount) for a trailer coupler.

Figure 3:
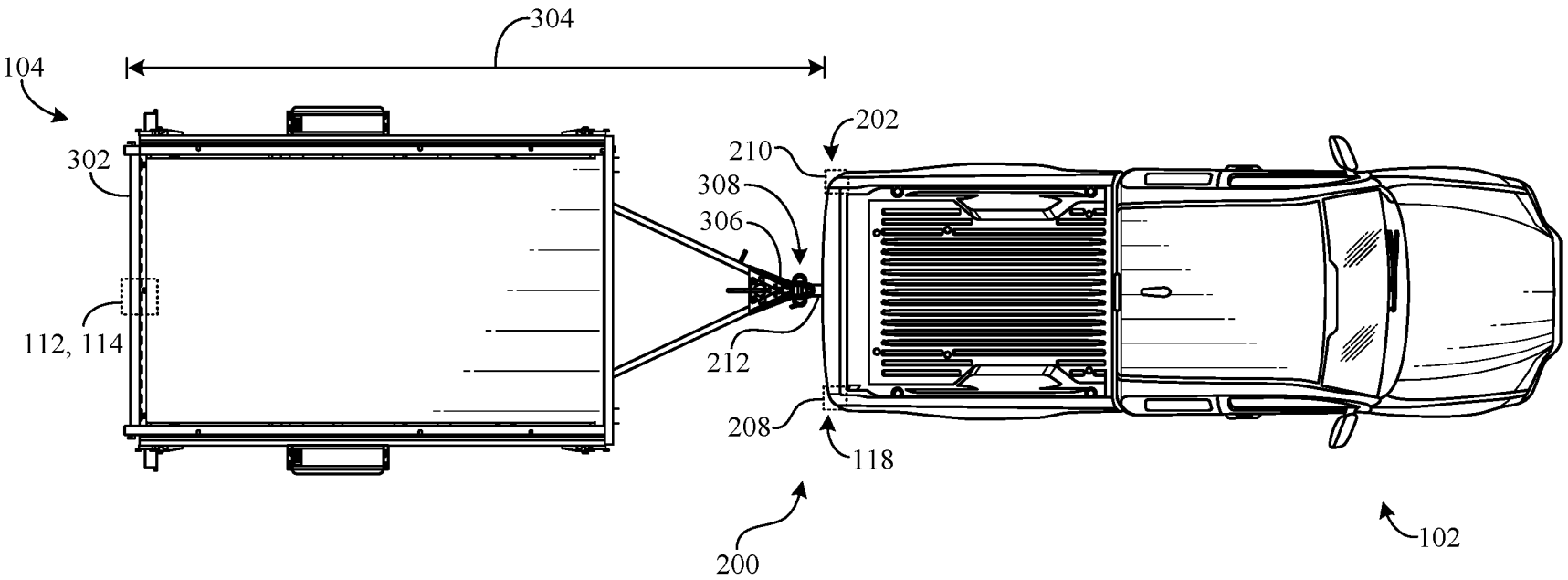
FIGS. 3 and 4 are top views of the example vehicle of FIG. 1 and the example trailer of FIG. 1.

FIG. 3 is a top view of the vehicle 102 and the trailer 104 of FIG. 1. According to the illustrated example of FIG. 3, the vehicle 102 is implemented with the antenna configuration 200 of FIG. 2. In some examples, the trailer device 112 and the secondary antenna 114 are positioned on and/or coupled to a door (e.g., a back door) 302 of the trailer 104, as shown in FIG. 3. In such example, to reduce (e.g., minimize) a distance 304 travelled by wireless signal(s) between the primary and secondary antennas 208, 210, 114, the first primary antenna 208 of FIG. 3 is positioned at a first location of interest (e.g., a rearmost corner) on the vehicle 102 that is defined by the first vehicle lamp 118. In particular, a space between the first location of interest and the secondary antenna 114 is less likely to be obstructed during wireless communications compared to other locations (e.g., a roof) on the vehicle 102. Additionally or alternatively, in some examples, the second primary antenna 210 of FIG. 3 is similarly positioned at a second location (e.g., a rearmost corner) on the vehicle 102 that is defined by the fourth vehicle lamp 202, which improves wireless coverage.

According to the illustrated example of FIG. 3, the trailer 104 includes a trailer coupler 306 that is coupled to a support structure (e.g., a frame) of the trailer 104. In particular, the trailer coupler 306 is movably coupled to the hitch 212 such that a movable joint (e.g., a ball joint) 308 is formed and/or defined by the hitch 212 and the trailer coupler 306. For example, the hitch 212 includes a ball mount operatively interposed between the hitch 212 and the trailer coupler 306. As a result, the trailer 104 can pivot relative to the movable joint 308 and/or, more generally, relative to the vehicle 102 during vehicle operation.

Figure 4:
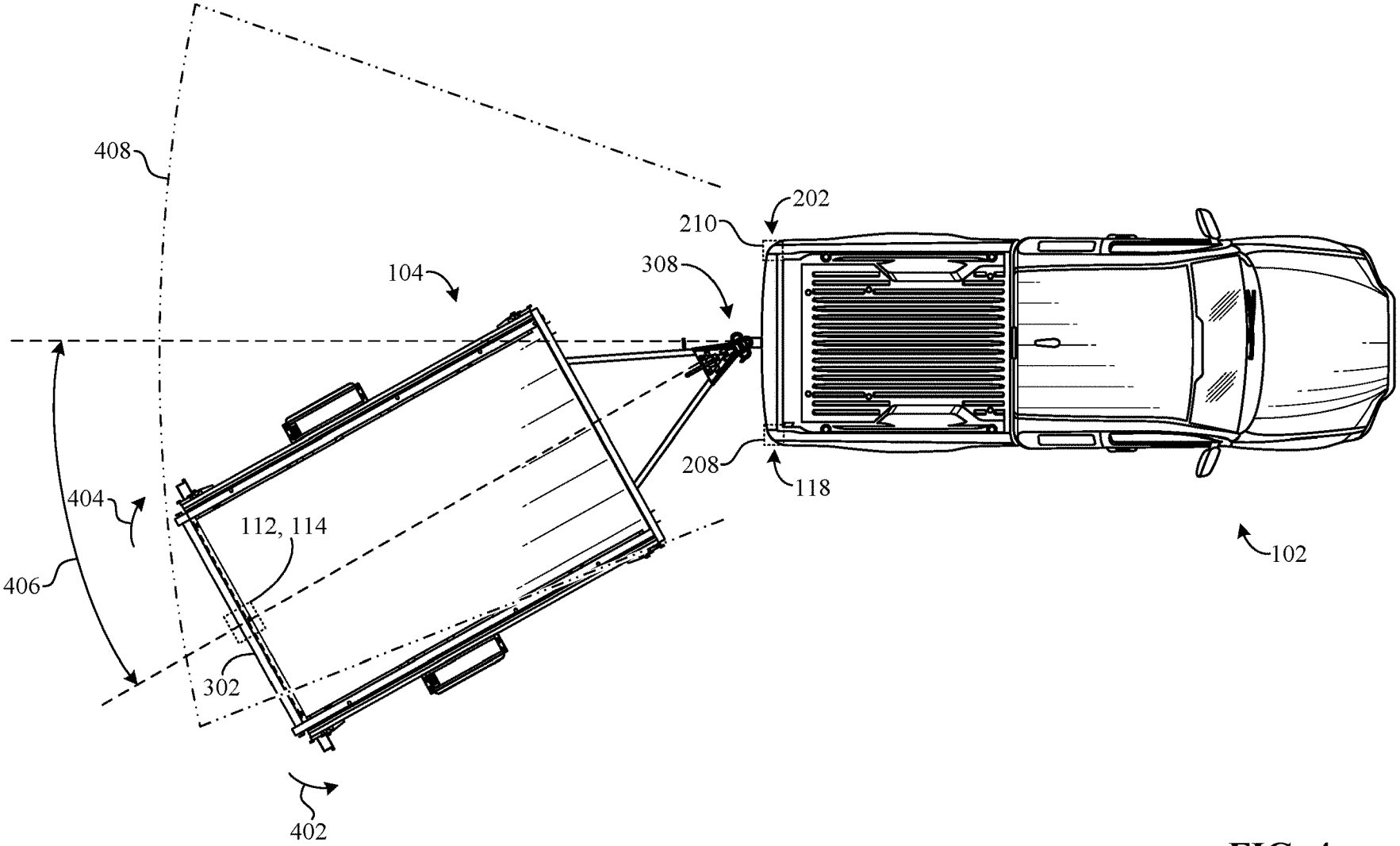

FIG. 4 is another top view of the vehicle 102 and the trailer 104 of FIG. 1. When the vehicle 102 of FIG. 4 performs a maneuver (e.g., a turn), the trailer 104 pivots relative to the movable joint 308 and/or an axis associated with the movable joint in a first direction (e.g., counter-clockwise) 402 or a second direction (e.g., clockwise) 404 opposite the first direction 402, for example, based on a steering angle associated the vehicle 102. As such, each of the trailer device 112 and the secondary antenna 114 moves relative to the primary antenna(s) 106 and/or travels across a predefined path (e.g., an arc-shaped path) 406, which may negatively affect transmission of wireless signal(s). In particular, by mounting the first and second primary antennas 208, 210 on the respective first and fourth lamps 118, 202, disclosed examples expand an example FOV 408 of wireless reception associated with the primary antenna(s) 208, 210, which effectively compensates for trailer articulation angles. For example, as the trailer 104 moves relative to the vehicle 102, the trailer electronic device 112 and/or the secondary antenna 114 substantially remain in the FOV 408 for any or all point(s) on the path 406. In this manner, disclosed examples substantially maintain wireless transmission of data between the vehicle device 108 and the trailer device 112 when the vehicle 102 is driving and/or performing a maneuver. In such examples, a distance between the secondary antenna 114 and the first primary antenna 208 decreases as the trailer 104 pivots relative to the joint 308 in the first direction 402. On the other hand, in such examples, a distance between the secondary antenna 114 and the second primary antenna 210 decreases as the trailer 104 pivots relative to the joint 308 in the second direction 404.

Although FIG. 4 depicts the FOV 408 of wireless reception associated with the primary antenna(s) 208, 210, in some examples, the primary antenna(s) 208, 210 are implemented differently such that the FOV 408 is different (e.g., larger and/or wider). Further, although FIGS. 3 and 4 depict the trailer device 112 and the secondary antenna 114 particularly mounted on the trailer 104, in some examples, the trailer device 112 and/or the secondary antenna 114 is/are implemented differently. For example, the trailer device 112 and/or the secondary antenna 114 is/are positioned on a portion of the trailer 104 that is different from the door 302.

Figure 5:
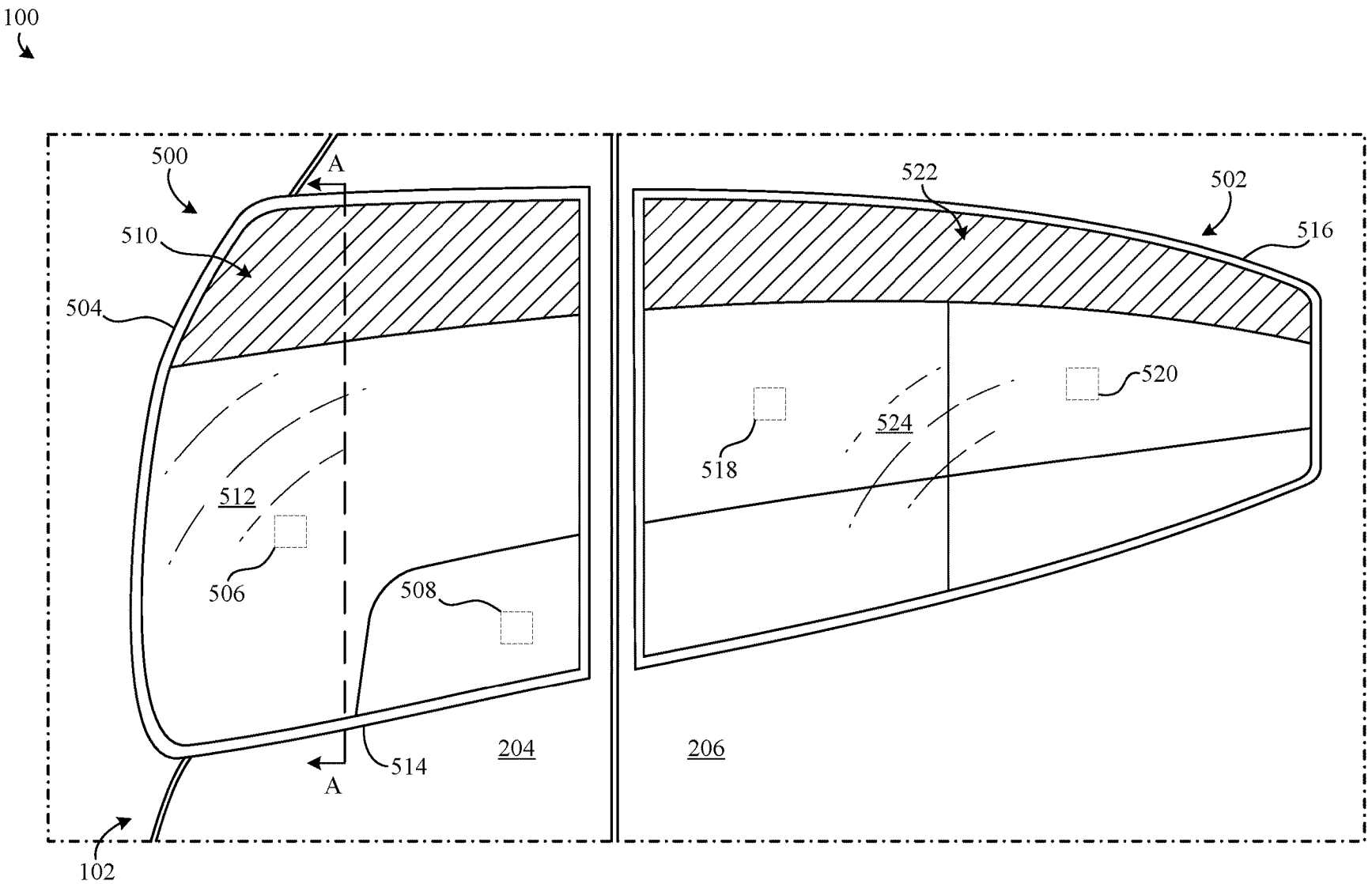
FIG. 5 is a view of two example vehicle lamps in which examples disclosed herein can be implemented.

FIG. 5 is a view of a fifth example vehicle lamp (e.g., an RCL) 500 and a sixth example vehicle lamp (e.g., an RRL) 502 of the communication system 100 in which examples disclosed herein can be implemented. In some examples, the fifth vehicle lamp 500 of FIG. 5 corresponds to and/or is used to implement one or more of the lamps 118, 120, 122, 202 of the vehicle 102 such as, for example, the first lamp 118 and/or the fourth lamp 202. Additionally or alternatively, in some examples, the sixth vehicle lamp 502 of FIG. 5 corresponds to and/or is used to implement one or more of the lamps 118, 120, 122, 202 of the vehicle 102. In particular, each of the fifth and sixth lamps 500, 502 of FIG. 5 is operatively coupled to a vehicle such as, for example, the vehicle 102 of FIGS. 1-4. For clarity, the fifth and sixth lamps 500, 502 will be discussed in connection with the vehicle 102 of FIG. 1-4. However, in some examples, the fifth lamp 500 of FIG. 5 and/or the sixth lamp 502 of FIG. 5 are similarly configured for use with one or more different vehicles.

According to the illustrated example of FIG. 5, the fifth vehicle lamp 500 includes a first example housing 504 and one or more example light sources (e.g., any of brake light(s), tail light(s), blinker(s), etc.) 506, 508 disposed in the first housing 504, two of which are shown in this example (i.e., a first light source 506 and a second light source 508). Further, in some examples, the fifth vehicle lamp 500 of FIG. 5 also includes one or more example bezels 510 positioned on the first housing 504, one of which is shown in this example (i.e., a first bezel 510). Further still, in some examples, the fifth vehicle lamp 500 of FIG. 5 also includes one or more example lenses (e.g., external lenses and/or internal lenses) 512 that are positioned on the first housing 504, one of which is shown in this example (i.e., a first lens 512).

The first housing 504 of FIG. 5 is positioned on and/or coupled to a portion of the vehicle body 204 such that the first housing 504 is supported by the portion of the vehicle body 204, for example, via one or more fasteners (e.g., studs, bolts, nuts, etc.) and/or one or more fastening methods or techniques. The first housing 504 can be constructed of one or more materials having suitable strength, rigidity, durability, and/or any other desired material parameter(s) and/or characteristic(s). In some examples, the first housing 504 of FIG. 5 is constructed of one or more plastics (e.g., poly carbonate (PC)) and/or any other suitable material. In particular, the first housing 504 is sized, shaped, structured, and/or configured to support and/or carry one or more components associated with the fifth vehicle lamp 500 such as, for example, the first bezel 510, the first lens 512, the first reflector 612, etc.

The light source(s) 506, 508 of the fifth vehicle lamp 500 can be implemented, for example, using (a) one or more light bulbs (e.g., single filament light bulbs, dual filament light bulbs, etc.), (b) one or more LEDs, (c) etc., (d) any other suitable light source(s), or (e) a combination thereof (e.g., some or all of (a), (b), (c), and/or (d)). Each of the light source(s) 506, 508 is electrically coupled to an electrical power source (e.g., a battery) and/or an ECU of the vehicle 102 associated with lighting control, for example, via the wiring system 110. In particular, the ECU is configured to control the light source(s) 506, 508 of the fifth lamp 500 to generate light (e.g., visible light) and/or emit the light, which may aid other driver(s) in identifying the vehicle 102 and/or a state of the vehicle 102.

In some examples, the first light source 506 of FIG. 5 is a tail light, a brake light, and/or a blinker (e.g., a turn signal). That is, in such examples, first light source 506 provides functionality associated with such vehicle lighting component(s). For example, the first light source 506 is configured to generate and/or emit light having a particular color (e.g., amber, red, yellow, etc.) that is indicative of a particular vehicle event (e.g., a braking event, a turning event, etc.) associated with the vehicle 102 that is occurring or likely to occur within a relatively short time interval. In some examples where the first light source 506 is a blinker, the first light source 506 is configured blink (e.g., at predefined frequency). Additionally, in some examples, the second light source 508 of FIG. 5 is a backup light, which is sometimes referred to as a reverse light. In such examples, the second light source 508 is configured to generate light having a particular color (e.g., white) that is indicative of a different diver event (e.g., a reversing event) associate with the vehicle 102 that is occurring or likely to occur within a relatively short time interval.

Although FIG. 5 depicts the two light sources 506, 508 of the fifth vehicle lamp 500, in some examples, the fifth vehicle lamp 500 is implemented differently to similarly provide such lighting functionality. For example, the fifth vehicle lamp 500 can be implemented using one or more other light sources in addition or alternatively to the first and second light sources 506, 508 of FIG. 5.

In some examples, the bezel(s) 510 of the fifth lamp 500 facilitate fastening the lens(es) 512 and/or trim to the first housing 504 proximate to a light source. For example, the first bezel 510 of FIG. 5 is configured to couple the first lens 512 to the first housing 504, which secures the first lens 512 and/or maintains a position of the first lens 512 relative to the first housing 504. Additionally or alternatively, the bezel(s) 510 serve as an aesthetic accessory. For example, each of the bezel(s) 510 may be provided with a particular graphical and/or structural design, which may be desirable to a driver or vehicle owner. Each of the bezel(s) 510 of the fifth lamp 500 can be constructed of one or more materials having suitable strength, rigidity, durability, and/or any other desired material parameter(s) and/or characteristic(s). In some examples, the first bezel 510 of FIG. 5 is constructed of one or more plastics (e.g., PC), one or more metals (e.g., chromium), and/or any other suitable material.

The lens(es) 512 of the fifth vehicle lamp 500 cover one or more internal components of the fifth vehicle lamp 500, which protects the internal component(s) from an environment external to the fifth lamp 500. As shown in FIG. 5, the first lens 512 extends over the first and second light sources 506, 508 and at least partially across the first housing 504, for example, from a first side 514 of the first housing 504 to the first bezel 510. As such, the first lens 512 of FIG. 5 is an external or outer lens. Each of the lens(es) 512 of the fifth lamp 500 can be constructed of one or more materials having suitable transparency, strength, rigidity, durability, and/or any other desired material parameter(s) and/or characteristic(s). In some examples, the lens(es) 512 of the fifth lamp 500 are constructed of one or more plastics (e.g., PC) and/or any other suitable material. In particular, the first lens 512 or at least a portion thereof is substantially transparent such that light can pass through the first lens 512. Although FIG. 5 depicts a single lens 512 of the fifth vehicle lamp 500, in some examples, the fifth vehicle lamp 500 is implemented differently, for example, using one or more different lenses (e.g., one or more internal or inner lenses) in addition or alternatively to the first lens 512 of FIG. 5.

Although FIG. 5 depicts aspects in connection with the fifth vehicle lamp 500, in some examples, such aspects likewise apply to one or more other vehicle lamps such as, for example, the first vehicle lamp 118, the second vehicle lamp 120, the third vehicle lamp 122, the fourth vehicle lamp 202, and/or the sixth vehicle lamp 502. For example, the sixth vehicle lamp 502 of FIG. 5 includes a second housing 516, a first light source 518, a second light source 520, a second bezel 522, and a second lens 524. In such examples, the second housing 516 is positioned on and/or coupled to a portion of the vehicle door 206 such that the first housing 504 is supported by the portion of the vehicle body 204, for example, via one or more fasteners (e.g., studs, bolts, nuts, etc.) and/or one or more fastening methods or techniques. Each of the first bezel 510, the first lens 512, the second bezel 522, and/or the second lens 524 is sometimes referred to as a stylized component of a vehicle lamp.

Figure 6:
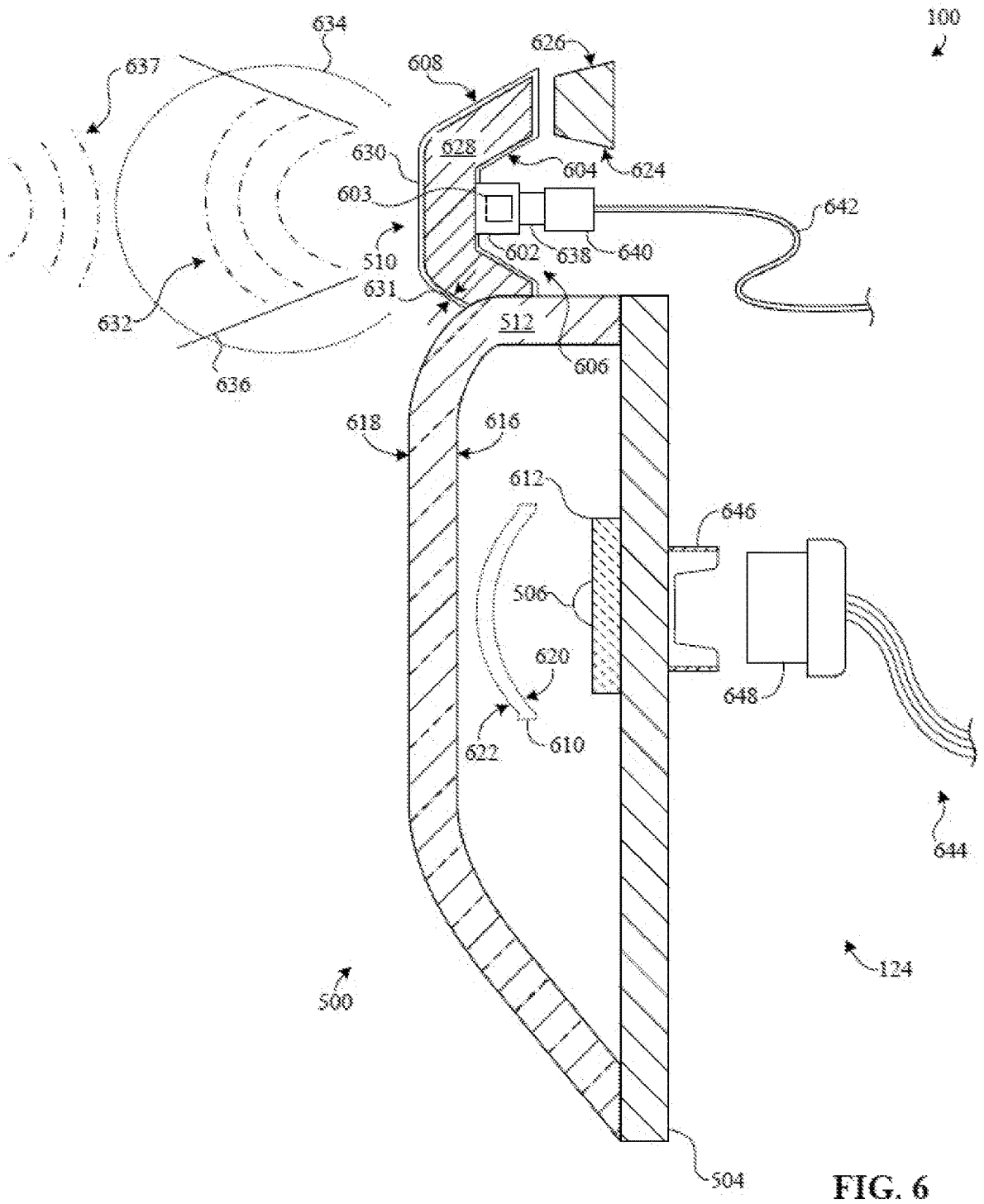
FIG. 6 is a cross-sectional view of one of the example vehicle lamps of FIG. 5 along line A-A and shows an example primary antenna in accordance with the teachings of this disclosure.

FIG. 6 is a cross-sectional view of the fifth vehicle lamp 500 of FIG. 5 along line A-A and shows a third example primary antenna (e.g., a Wi-Fi antenna, an LTE antenna, a GPS antenna, etc.) 602 in accordance with the teachings of this disclosure. In some examples, the third primary antenna 602 corresponds to and/or is used to implement one or more of the other vehicle antenna(s) 106 of the communication system 100 such as, for example, the first primary antenna 208 and/or the second primary antenna 210. As such, aspects depicted above in connection with the primary antenna(s) 106, 208, 210 of FIGS. 1-4 likewise apply to the third primary antenna 602 of FIG. 6. For example, the third primary antenna 602 of FIG. 6 is mounted on a portion of the fifth vehicle lamp 500 and electrically coupled to the vehicle device 108. In such examples, the third primary antenna 602 is part of the fifth vehicle lamp 500 and/or, more generally, part of the communication system 100. According to the illustrated example of FIG. 6, the third primary antenna 602 is configured to electromagnetically interact with an antenna external to the fifth vehicle lamp 500 such as, for example, the secondary antenna 114. In some examples, the third primary antenna 602 and the secondary antenna 114, together, are configured to provide wireless communication between the vehicle and trailer electronic devices 108, 112.

Additionally, in some examples, to facilitate operation of the third primary antenna 602, the third primary antenna 602 also includes example antenna circuitry (e.g., a circuitry package) 603 electrically coupled to the third primary antenna 602, for example, via one or more transmission or signal wires. The antenna circuitry 603 of FIG. 6 can be implemented using one or more circuits (e.g., parallel resonance circuits) and/or one or more circuit elements (e.g., resistors, capacitors, inductors, etc.). In particular, in such examples, the antenna circuitry 603 is configured to provide a desired impedance to the third primary antenna 602, for example, such that the impedance sufficiently matches an associated transmission line providing electrical power to the third primary antenna 602.

According to the illustrated example of FIG. 6, the third primary antenna 602 of FIG. 6 is embedded in a portion (e.g., a substrate) of the first bezel 510 of the fifth vehicle lamp 500. In some examples, the third primary antenna 602 is positioned on a first surface (e.g., an inner, metallized surface) 604 of the first bezel 510 and/or coupled to the first surface 604, for example, via one or more fasteners and/or one or more fastening methods or techniques. Accordingly, in such examples, the third primary antenna 602 is supported and/or carried by the first bezel 510. Consequently, the third primary antenna 602 of FIG. 6 is also supported and/or carried by the first housing 504. In some such examples, the first bezel 510 of FIG. 6 includes an example pocket or cavity 606 that is formed and/or defined by the first surface 604 of the first bezel 510. In such examples, the cavity 606 of FIG. 6 is sized and/or shaped to receive the third primary antenna 602 or at least a portion thereof. For example, as shown in FIG. 6, the third primary antenna 602 or at least a portion thereof is positioned in the cavity 606. The first bezel 510 of FIG. 6 is coupled to a portion of the first housing 504 and a portion of the first lens 512.

Although FIG. 6 depicts the third primary antenna 602 coupled to the first surface 604 of the first bezel 510, in some examples, the third primary antenna 602 is coupled to a different portion of the first bezel 510. In such examples, the third primary antenna 602 is positioned on and/or coupled to a second example surface (e.g., an outer, metallized surface) 608 of the first bezel 510, which may be part of or separate from the first surface 604.

Further, although FIG. 6 depicts the third primary antenna 602 particularly mounted on the first bezel 510, in some examples, the third primary antenna 602 is similarly mountable on one or more other components of the fifth vehicle lamp 500 such as, for example, (a) the first housing 504, (b) the first lens 512, (c) a third example lens (e.g., an inner lens) 610 of the fifth lamp 500, which is represented by the dotted/dashed lines of FIG. 6, (d) an example reflector (e.g., a parabolic reflector) 612 of the fifth lamp 500, (e) any other suitable component of the fifth lamp 500, or (f) a combination thereof. In such examples, the third primary antenna 602 is positioned on and/or coupled to, for example, (a) a first example surface (e.g., an inner, transparent surface) 616 of the first lens 512, (c) a second example surface (e.g., an outer, transparent surface) 618 of the first lens 512, (d) a first example surface (e.g., an inner, transparent surface) 620 of the third lens 610, (e) a second example surface (e.g., an outer, transparent surface) 622 of the third lens 610, (f) a first example surface (e.g., an inner, opaque surface) 624 of the first housing 504, or (g) a second example surface (e.g., an outer, opaque surface) 626 of the first housing 504.

As such, in some examples, the third primary antenna 602 of FIG. 6 is positioned external to the first housing 504 such that the third primary antenna 602 or at least a portion thereof is exposed to an external environment (i.e., an environment external to the fifth lamp 500). In such examples, the antenna circuitry 603 of FIG. 6 is positioned in the first housing 504. Alternatively, in some examples, the third primary antenna 602 or at least a portion thereof floats within the first housing 504. In such examples, the fifth lamp 500 includes one or more example support structures (e.g., brackets) configured to couple the third primary antenna 602 to a portion of the first housing 504.

The third lens 610 of FIG. 6 is configured to couple to a portion of the first housing 504, for example, via another bezel (e.g., similar to the first bezel 510) coupled between the portion of the first housing 504 and the third lens 610. As shown in FIG. 6, the third lens 610 is positioned in the first housing 504 and/or behind the first lens 512 and extends over or covers the first light source 506. Further, the third lens 610 is interposed between the first lens 512 and the first light source 506. In such examples, the third lens 610 may be configured to enhance the light generated by and/or emitted from the first light source 506.

The reflector 612 of FIG. 6 is coupled to a portion of the first housing 504, for example, via one or more fasteners and/or one or more fastening methods or techniques. In some examples, the reflector 612 is positioned in the first housing 504 adjacent the first light source 506. In particular, the reflector 612 of FIG. 6 is sized, shaped, structured, and/or configured to reflect the light generated by and/or emitted from the first light source 506. In some examples, the reflector 612 concentrates or focuses the light, which increases light intensity. On the other hand, in some examples, the reflector 612 distributes the light over a relatively wide angle, which illuminates a relatively large area and reduces the light intensity.

According to the illustrated example of FIG. 6, the first bezel 510 includes a first example substrate (e.g., a layer of a material) 628 on which one or more example conductive structures are positionable. The first substrate 628 of FIG. 6 is sized, shaped, and/or otherwise configured to provide structural integrity to the first bezel 510 and can be constructed of, for example, one or more plastics (e.g., PC) and/or any other suitable material(s). In some examples, the third primary antenna 602 is embedded in the first substrate 628. In such examples, the third primary antenna 602 or a portion thereof can extend at least partially into a surface (e.g., an outer surface) of the first substrate 628.

Additionally, in some examples, to facilitate wireless communication between the vehicle and trailer devices 108, 112, the communication system 100 also includes a first example conductive structure (e.g., an antenna element) 630 positioned on and/or coupled to at least a portion of the first substrate 628. The first conductive structure 630 of FIG. 6 forms and/or defines a first example layer of interest (e.g., an outer layer and/or a metallic layer) 631 of the first bezel 510. That is, the first bezel 510 of FIG. 6 includes the first layer 631, which extends over and/or covers at least a portion of the first substrate 628. In particular, the first conductive structure 630 of FIG. 6 is electrically coupled to the third primary antenna 602 and/or the antenna circuitry 603, which enhances performance of the third primary antenna 602. In some examples, the third primary antenna 602 is at least partially formed and/or defined by the first conductive structure 630. That is, in such examples, the first conductive structure 630 of FIG. 6 is a substantially complete primary antenna of the communication system 100 (i.e., one of the primary antenna(s) 106, 208, 210, 602) or at least an extension of the primary antenna.

The first conductive structure 630 of FIG. 6 includes, for example, (a) one or more metal plates at least partially covering the first substrate 628, (b) one or more conductive traces at least partially covering the first substrate 628, (c) one or more conductive inks deposited on the first substrate 628, (d) etc., or (e) a combination thereof (e.g., some or all of (a), (b), (c), and/or (d)). In particular, the first layer 631 of FIG. 6 and/or, more generally, the first conductive structure 630 of FIG. 6 is/are constructed of a material, such as a metal (e.g., chromium, etc.), that can sufficiently conduct electricity and/or otherwise carry an electric current. As such, in some examples, the first layer 631 of FIG. 6 is a metallic layer. As shown in FIG. 6, the first layer 631 has a substantially uniform thickness across at least a dimension (e.g., a length, a height, or a width) of the first substrate 628.

In some examples, the vehicle device 108 is configured control (e.g., via the first transmitter or the first transceiver) the third primary antenna 602 and/or the first conductive structure 630 to generate one or more outgoing or first wireless signals 632 receivable by the secondary antenna 114. That is, in some examples, the third primary antenna 602 and the first conductive structure 630 function cooperatively and, together, are configured to convert the first electric current into the first wireless signal(s) 632 in response to the vehicle electronic device 108 applying the first electric current to the third primary antenna 602 and/or the first conductive structure 630. In particular, in such examples, each of the first layer 631, and/or, more generally, the first conductive structure 630 of FIG. 6 is sized, shaped, structured, and/or otherwise configured to adjust one or more operating parameters associated with the third primary antenna 602 during a first wireless communication process associated with the vehicle electronic device 108 in which the vehicle electronic device 108 provides data to the trailer electronic device 112. That is, the first wireless communication process corresponds to the vehicle electronic device 108 wireless transmitting data to the trailer electronic device 112. In some examples, each of the first layer 631, and/or, more generally, the first conductive structure 630 of FIG. 6 provides an adjustment for any of (a) a signal range associated with the third primary antenna 602, (b) a gain associated with the third primary antenna 602, (c) an example radiation pattern 634 (as represented by the dotted lines of FIG. 6) associated with the third primary antenna 602, (d) an example beamwidth 636 associated with the third primary antenna 602, (e) an efficiency associated with the third primary antenna 602, (f) etc. (g) any other antenna parameter, or (h) a combination thereof (e.g., some or all of (a), (b), (c), (d), (e), (f), and/or (g)). For example, the first layer 631 of FIG. 6 causes the radiation pattern 634 to change (e.g., expand or narrow) when the first conductive structure 630 is electrically coupled to the third primary antenna 602 during the first communication process. In another example, the first layer 631 causes the beamwidth 636 to change (e.g., expand or narrow) when the first conductive structure 630 is electrically coupled to the third primary antenna 602 during the first communication process. In another example, the first layer 631 causes one or more (e.g., all) of the signal range, the gain, and/or the efficiency to change (e.g., increase) when the first conductive structure 630 is electrically coupled to the third primary antenna 602 during the first communication process. On the other hand, in some examples where the first conductive structure 630 is a substantially complete primary antenna, only the first conductive structure 630 is configured to the convert the first electric current into first wireless signal(s) 632.

Additionally or alternatively, in some examples, the third primary antenna 602 and/or the first conductive structure 630 receive one or more incoming or second wireless signal(s) 637, for example, emitted from the secondary antenna 114. That is, in some examples, the third primary antenna 602 and the first conductive structure 630 function cooperatively and, together, are configured to convert the second wireless signal(s) 637 into the second electric current for processing by the vehicle electronic device 108. In particular, in such examples, each of the first layer 631 of FIG. 6 and/or, more generally, the first conductive structure 630 of FIG. 6 is sized, shaped, structured, and/or otherwise configured to similarly adjust the operating parameter(s) associated with the third primary antenna 602 during a second wireless communication process associated with the vehicle electronic device 108 in which the vehicle electronic device 108 obtains data from the trailer electronic device 112. That is, the second wireless communication process corresponds to the trailer electronic device 112 wireless transmitting data to the vehicle electronic device 108. On the other hand, in some examples where the first conductive structure 630 is a substantially complete primary antenna, only the first conductive structure 630 is configured to convert the second wireless signal(s) 637 into the second electric current for processing by the vehicle electronic device 108. As such, in some examples, the first conductive structure 630 of FIG. 6 is configured to convert (a) the first electric current applied to the first conductive structure 630 into the first wireless signal(s) 632 and/or (b) convert the second wireless signal(s) 637 received by the first conductive structure 630 into the second electric current for processing by the vehicle electronic device 108.

Thus, the primary antenna 602 and/or the first conductive structure 630 can be advantageously used in connection with receiving one or more wireless signals and/or transmitting one or more wireless signals. In some such examples, the first conductive structure 630 forms and/or defines one more example metallization patterns, which further improves antenna functionality and/or serves as an aesthetic feature, as discussed further below in connection with FIGS. 7 and 8. For example, the first conductive structure 630 can be provided with a first example metallization pattern that includes one of a zig-zag pattern, a hatching pattern, a honeycomb pattern, a stipe pattern, etc., and/or any other suitable pattern. According to the illustrated example of FIG. 6, the third primary antenna 602 and/or the first conductive structure 630 is/are operable over at least one range of frequencies (sometimes referred to as a bandwidth), which is at least partially defined by the circuitry 603. For example, the first wireless signal(s) 632 and/or the second wireless signal(s) 637 correspond to one or more particular bands such as, for example, any of a 700 megahertz (MHz) band, a 900 MHz band, a 2.4 gigahertz (GHz) band, a 3.6 GHz band, a 4.9 GHz band, a 5 GHz band, a 5.9 GHz band, etc. and/or any other suitable band that may be associated with vehicle communication standards or regulations.

In some examples, to facilitate connecting the third primary antenna 602 to the wiring system 110, the connection interface 124 of FIG. 6 includes a first primary connector (e.g., a female electrical connector such as a socket) 638 operatively coupled to the third primary antenna 602 and/or the antenna circuitry 603. Further, in such examples, the connection interface 124 of FIG. 6 also includes a first secondary connector (e.g., a male electrical connector such a pin or a set of pins) 640 connected to an example wire 642 extending away from the first secondary connector 640. In particular, the first secondary connector 640 is insertable in the first primary connector 638, thereby providing an electrical connection between the third primary antenna 602 and the wiring system 110.

Additionally or alternatively, in some examples, the connection interface 124 also includes an example wire harness (e.g., one or more wires coupled together) 644 for the fifth vehicle lamp 500, which is sometimes referred to as a wiring harness. The wire harness 644 of FIG. 6 facilitates providing electrical power to the fifth vehicle lamp 500 and/or the third primary antenna 602. In such examples, to facilitate connecting the fifth lamp 500 to the wiring system 110, the connection interface 124 of FIG. 6 also includes a second primary connector (e.g., a male electrical connector such as a socket) 646 operatively coupled to the first housing 504 and a second secondary connector (e.g., a female electrical connector such as a pin or a set of pins) 648 operatively coupled to the wiring harness 644. In particular, the second secondary connector 648 is insertable in the second primary connector 646, thereby providing an electrical connection between (a) one or more (e.g., all) components (e.g., any of the first light source 506, the second light source 508, the third primary antenna 630, etc.) associated with the fifth lamp 500 and (b) the wiring system 110.

In some examples, the wire harness 644 of FIG. 6 is at least partially formed and/or defined by the wire 642 associated with the third primary antenna 602. That is, in such examples, the wire 642 of FIG. 6 is integrated into the wiring harness 644 such that the wire 642 and the wiring harness 644 provide a single-piece or integral component. Alternatively, in some examples, the wire 642 of FIG. 6 does not form part of the wiring harness 644 or is separate from the wiring harness 644. In some such examples, the wire 642 extends through first housing 504 from the third primary antenna 602 to the second primary connector 646. Further, in such examples, the wire 642 is electrically coupled to the second primary connector 646 such that, when the second secondary connector 648 is inserted in the second primary connector 646, both the fifth vehicle lamp 500 and the third primary antenna 602 electrically couple to the wiring system 110. As such, in some examples, when the wire harness 644 is installed, the wire harness 644 electrically couples both the fifth vehicle lamp 500 and the third primary antenna 602 to the wiring system 110 and, consequently, to the vehicle electronic device 108.

Figures 7A, 7B, 7C:
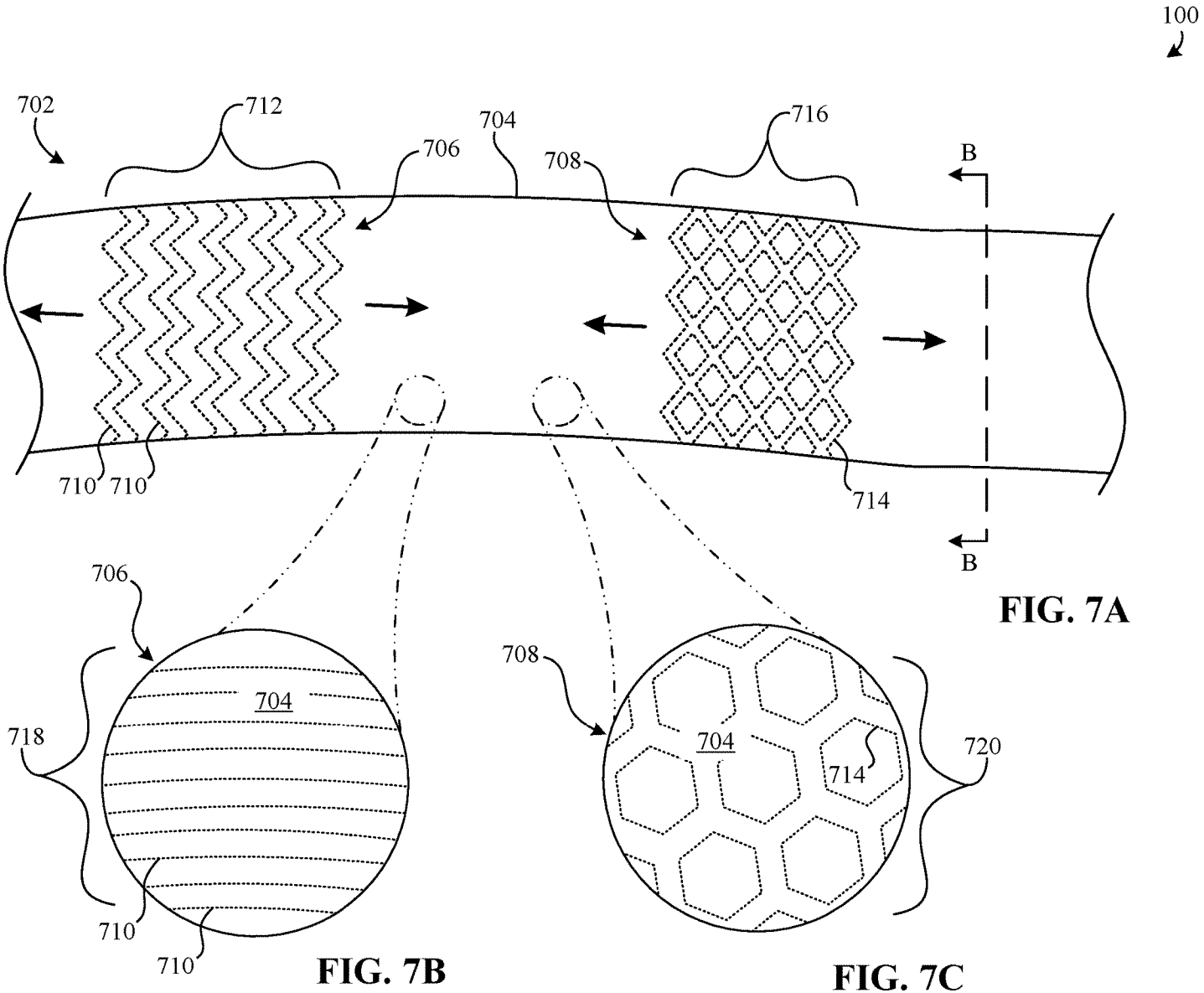
FIG. 7A is a partial-view of an example stylized component of a vehicle lamp in accordance with the teachings of this disclosure.
FIGS. 7B and 7C are enlarged partial-views of an example substrate of the example stylized component of FIG. 7A and shows example conductive structures positioned behind the example substrate in accordance with the teachings of this disclosure.

FIG. 7A is a partial view of an example stylized component 702 of a vehicle lamp in accordance with the teachings of this disclosure. The stylized component 702 of FIG. 7A is, for example, one of a lens, a bezel, trim, etc. In some examples, the stylized component 702 of FIG. 7A corresponds to and/or is used to implement at least a portion of one of the lamps 118, 120, 122, 202, 500, 502 of the vehicle 102. For example, the stylized component 702 of FIG. 7A corresponds to and/or is used to implement one or more (e.g., all) of the first bezel 510, the first lens 512, the second bezel 522, the second lens 524, and/or the third lens 610. As such, aspects depicted above in connection with the one or more (e.g., all) of the first bezel 510, the first lens 512, the second bezel 522, the second lens 524, and/or the third lens 610 likewise apply to the stylized component 702 of FIG. 7A. For example, the stylized component 702 of FIG. 7A is configured to couple to the first or second housing 504, 516 such that the stylized component 702 is supported by the first or second housing 504, 516.

According to the illustrated example of FIG. 7A, the stylized component 702 includes a second example substrate 704 on which one or more example conductive structures of the communication system 100 are positionable. In some examples where the stylized component 702 is a lens, the second substrate 704 of FIG. 7A or a portion thereof is substantially transparent, which facilitates illumination of the stylized component 702 and/or allows light to pass through the stylized component 702. That is, in such examples, the second substrate 704 or the portion thereof is constructed of one or more materials that are substantially transparent. On the other hand, in some examples where the stylized component 702 is a bezel, the second substrate 704 or a portion thereof is substantially opaque. That is, in such examples, the second substrate 704 is constructed of one or more materials that are substantially opaque.

According to the illustrated example of FIG. 7A, the communication system 100 of FIG. 7A also includes one or more example conductive structures 706, 708 positioned on the second substrate 704, two of which are shown in this example (i.e., a second conductive structure 706 and a third conductive structure 708). In some examples, the second conductive structure 706 corresponds to and/or is used to implement the first conductive structure 630 of FIG. 6. Similarly, in some examples, the third conductive structure 708 corresponds to and/or is used to implement the first conductive structure 630 of FIG. 6. As such, aspects depicted above in connection with first conductive structure 630 of FIG. 6 likewise apply to the second conductive structure 706 and/or the third conductive structure 708. Further, in some examples, the second and third conductive structures 706, 708 are coupled together and/or combined to provide a single conductive structure.

The second conductive structure 706 of FIG. 7A forms and/or defines one or more example metallic layers 710 of the stylized component 702 (as represented by the dotted/dashed lines of FIG. 7A), which are positioned behind the second substrate 704 in this example. The metallic layer(s) 710 of the stylized component 702 can be implemented, for example, using one or more metal plates at least partially covering the second substrate 704, one or more conductive traces at least partially covering the second substrate, etc. That is, the stylized component 702 of FIG. 7A has the metallic layer(s) 710, each of which at least partially covers and/or extends over the second substrate 704. In some examples, each of the metallic layer(s) 710 of the stylized component 702 are electrically coupled to one or more (e.g., all) of the primary antenna(s) 106, 208, 210, 602 of the communication system 100, which enhances antenna performance.

Additionally, in some examples, the second conductive structure 706 forms and/or defines a second example metallization pattern, which further enhances antenna performance and/or serves as another aesthetic feature. According to the illustrated example of FIG. 7A, the metallic layer(s) 710 of the stylized component 702 are particularly sized, shaped, and/or arranged on the second substrate 704 to provide the second metallization pattern 712. As shown in FIG. 7A, the second metallization pattern 712 is a zig-zag pattern. In such examples, each of the metallic layer(s) 710 is substantially zig-zag shaped. As shown in FIG. 7A, each of the metallic layer(s) 710 is evenly or equally spaced from each other. Further, each of the metallic layer(s) 710 has a width that is substantially uniform across a dimension (e.g., a width) of the stylized component 702. Additionally, in some examples, at least some or all of the metallic layer(s) 710 are connected together or directly contact each other.

The third conductive structure 708 of FIG. 7A forms and/or defines one or more other example metallic layers 714 of the stylized component 702, one of which is shown in this example (as represented by the dotted/dashed lines of FIG. 7A). Additionally, in some examples, the third conductive structure 708 forms and/or defines a third example metallization pattern 716 different from the second metallization pattern 712, which further enhances antenna performance and/or serves as another aesthetic feature. According to the illustrated example of FIG. 7A, the metallic layer(s) 714 associated with the third conductive structure 708 are particularly sized, shaped, and/or arranged relative to the second substrate 704 to provide the third metallization pattern 716. As shown in FIG. 7A, the third metallization pattern 716 is a hatching pattern.

Although FIG. 7A depicts the second and third metallization patterns 712, 716 covering a portion of the second substrate 704, in some examples, the second metallization pattern 712 and/or the third metallization pattern 716 is/are implemented differently. In some examples, the second metallization pattern 712 is expanded to cover more or substantially all of the second substrate 704, for example, by producing the stylized component 702 with one or more additional metallic layers. Similarly, in some examples, the third metallization pattern 716 is expanded to cover more or substantially all of the second substrate 704.

In some examples, the vehicle electronic device 108 applies the first electric current or a portion thereof to the metallic layer(s) 710, 714 of the stylized component 702 during the first wireless communication process associated with the vehicle electronic device 108. In such examples, the metallic layer(s) 710, 714, together, are configured to convert the first electric current into the first wireless signal(s) 632, which are receivable by the secondary antenna 114. Additionally or alternatively, in examples where the metallic layer(s) 710, 714 receive the second wireless signal(s) 637 during the second wireless communication process, the metallic layer(s) 710, 714 are configured to convert the second wireless signal(s) 637 into the second electric current for processing by the vehicle electronic device 108.

Although FIG. 7A depicts the zig-zag and hatching patterns, in some examples, one or more (e.g., all) of the metallic layer(s) 710, 714 of the stylized component 702 are implemented differently to provide one or more different metallization patterns while sufficiently maintaining antenna functionality. For example, one or more of the metallic layer(s) 710, 714 of the stylized component 702 are sized, shaped, and/or arranged differently relative to the second substrate 704, as discussed further below in connection with FIGS. 7B and 7C.

FIG. 7B is an enlarged partial-view of the second substrate 704 of the stylized component 702 of FIG. 7A and shows the second conductive structure 706 positioned behind the second substrate 704. According to the illustrated example of FIG. 7B, at least some or all of the metallic layer(s) 710 of stylized component 702 are particularly sized, shaped, and/or arranged relative to the second substrate 704 to provide a fourth example metallization pattern 718 different from the second and third metallization patterns 712, 716. That is, the second conductive structure 706 of FIG. 7B forms and/or defines the fourth metallization pattern 718, which covers and/or extends over at least a portion of the second substrate 704. As shown in FIG. 7B, the fourth metallization pattern 718 of FIG. 7B is a stripe pattern. In such examples, each of the metallic layer(s) 710 of the stylized component 702 is substantially linear and/or extends along the second substrate 704 parallel relative to the each other. Additionally, in some such examples, each of the metallic layer(s) 710 is curved or includes one or more curvatures.

FIG. 7C is another enlarged partial-view of the second substrate 704 of the stylized component 702 of FIG. 7A and shows the third conductive structure 708 positioned behind the second substrate 704. According to the illustrated example of FIG. 7C, at least some or all of the metallic layer(s) 714 of the stylized component 702 are particularly sized, shaped, and/or arranged relative to the second substrate 704 to provide a fifth example metallization pattern 720 different from the second, third, and fourth metallization patterns 712, 716, 718. That is, the third conductive structure 708 of FIG. 7B forms and/or defines the fifth metallization pattern 720, which covers and/or extends over at least a portion of the second substrate 704. As shown in FIG. 7B, the fifth metallization pattern 720 of FIG. 7B is a honeycomb pattern. In such examples, each of the metallic layer(s) 714 of the stylized component 702 is substantially honeycomb-shaped.

The metallic layer(s) 710, 714 of FIGS. 7A, 7B, and 7C are coupled to the second substrate 704, for example, via one or more metallization processes. In some examples, the metallic layer(s) 710, 714 are formed on the second substrate 704 via one or more example plating processes (e.g., a chrome plating process). Additionally or alternatively, in some examples, the metallic layer(s) 710, 714 are printed on the second substrate 704 using one or more conductive inks. Additionally, in some examples, when forming the metallization pattern(s) 712, 716, 718, 720, material is removed from the metallic layer(s) 710, 714 such that the metallization pattern(s) expose a transparent surface of the stylized component 702, for example, via one or more laser etching processes, as discussed further below in connection with FIG. 8.

Figure 8:
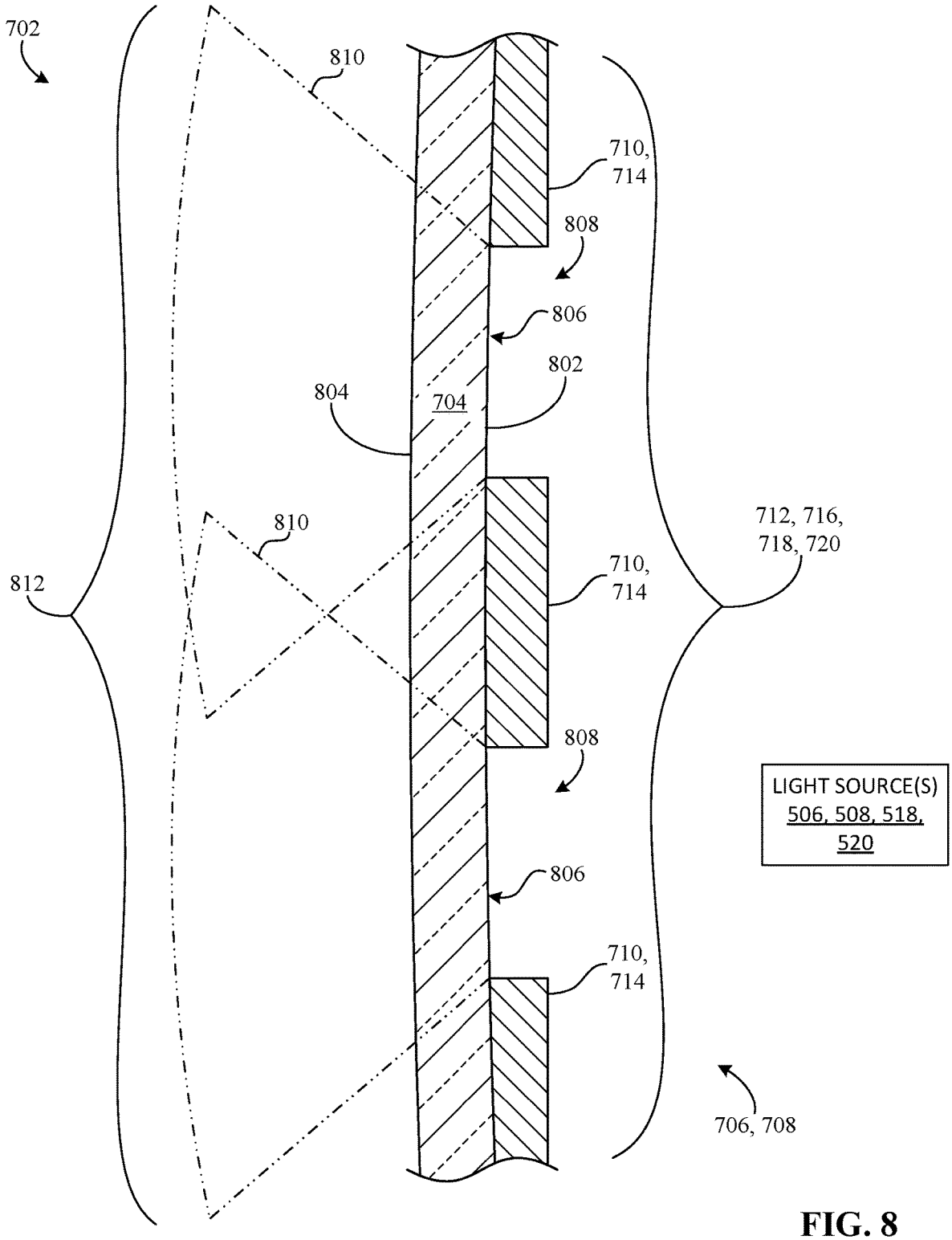
FIG. 8 is a cross-sectional view of the example stylized component of FIG. 7A along line B-B and shows an example conductive structure in accordance with the teachings of this disclosure.

FIG. 8 is a cross-sectional view of the stylized component 702 of FIG. 7A along line B-B and shows one of the second or third conductive structure(s) 706, 708, which will be referred to as the conductive structure 706, 708 in connection with FIG. 8, for clarity. According to the illustrated example of FIG. 8, the metallic layer(s) 710, 714 are positioned on a first side (e.g., an inner or interior side) 802 of the second substrate 704, for example, facing at least one of the light source(s) 506, 508, 518, 520. Additionally or alternatively, in some examples, at least some or all of the metallic layer(s) 710, 714 of the stylized component 702 are positioned on a second side (e.g., an outer or exterior side) 804 of stylized component 702 opposite the first side 802.

According to the illustrated example of FIG. 8, the metallization pattern(s) 712, 716, 718, 720 expose one or more areas or surfaces 806 of the second substrate 704 that is/are transparent. For example, as shown in FIG. 8, adjacent ones of the metallic layer(s) 710, 714 of the stylized component 702 form and/or define apertures 808 positioned on the conductive structure 706, 708. In such examples, the aperture(s) 808 are particularly sized, shaped, and/or arranged relative to each other to provide an aperture pattern (e.g., one of a zig-zag pattern, a hatching pattern, a honeycomb pattern, or a stipe pattern) that substantially corresponds to and/or matches one of the metallization pattern(s) 712, 716, 718, 720. In particular, light 810 generated by and/or emitted from the light source(s) 506, 508, 518, 520 passes through the transparent surface(s) 806 and the conductive structure 706, 708, via the aperture(s) 808, to provide an example light pattern 812 visible to a person external to the vehicle 102.

Although FIGS. 7 and 8 depict aspects in connection with the second and third conductive structures 706, 708, in some examples, such aspects likewise apply to one or more other conductive structures of the communication system 100 such as, for example, the first conductive structure 630.

Figure 9:
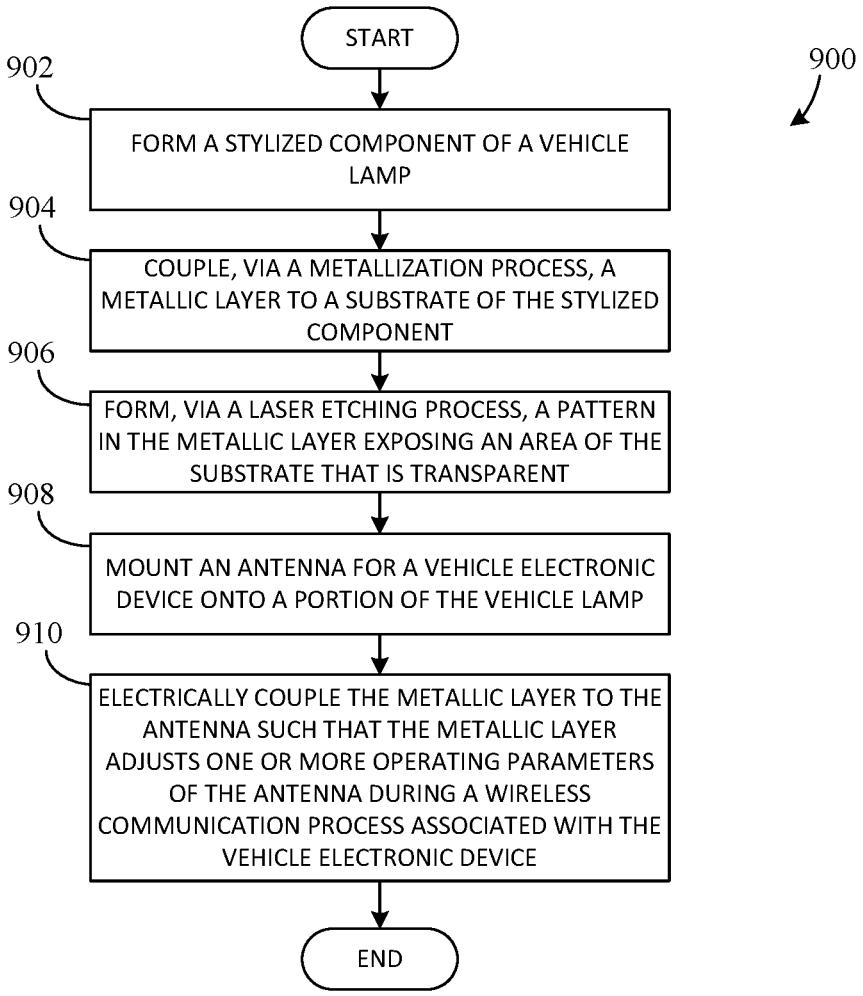
FIG. 9 is a flowchart representative of an example method that can be carried out to provide an antenna for a vehicle electronic device.

FIG. 9 is a flowchart representative of an example method 900 that can be carried out to provide an antenna for a vehicle electronic device. The example method 900 can be implemented in any of the communication system 100 of FIGS. 1, 2, and 5-7, the vehicle 102 of FIGS. 1-5, the first vehicle lamp 118 of FIGS. 1-4, the second vehicle lamp 120 of FIG. 1, the third vehicle lamp 122 of FIG. 1, the fourth vehicle lamp 202 of FIGS. 2-4, the fifth vehicle lamp 500 of FIGS. 5 and 6, and/or the sixth vehicle lamp 502 of FIG. 5. In particular, the example method 900 of FIG. 9 is effective in providing one or more (e.g., all) of the primary antenna(s) 106, 208, 210, 602 of the communication system 100.

The example method 900 of FIG. 9 begins by forming a stylized component of a vehicle lamp (block 902). In some examples, the stylized component 702 of FIGS. 7 and 8 is formed, for example, via one or more injection molding processes. Additionally or alternatively at block 902, one or more (e.g., all) of the first bezel 510, the first lens 512, the second bezel 522, the second lens 524, and/or the third lens 610 is/are similarly formed.

The example method 900 of FIG. 9 also includes coupling, via a metallization process, a metallic layer to a substrate of the stylized component (block 904). In some examples, the metallic layer(s) 710, 714 of FIGS. 7 and 8 are coupled to the second substrate 704 of the stylized component 702 via one or more metallization processes.

The example method 900 of FIG. 9 also includes forming, via a laser etching process, a pattern in the metallic layer exposing an area of the substrate that is transparent (block 906). In some examples, the metallization pattern(s) 712, 716, 718, 720 of FIGS. 7 and 8 are formed in the metallic layer(s) 710, 714 via one or more laser etching processes, which expose the transparent area(s) 806 of the second substrate 704.

The example method 900 of FIG. 9 also includes mounting an antenna for a vehicle electronic device onto a portion of the vehicle lamp (block 908). In some examples, one or more of the primary antenna(s) 106, 208, 210, 602 is/are mounted on a portion of one of the vehicle lamp(s) 118, 120, 122, 500, 502. For example, the third primary antenna 602 of FIG. 6 is mounted on the first bezel 510. Further, in some examples at block 908, the example method 900 of FIG. 9 also includes embedding the antenna in a portion of the stylized component. For example, the third primary antenna 602 of FIG. 6 is embedded in the first substrate 628 of the first bezel 510.

The example method 900 of FIG. 9 also includes electrically coupling the metallic layer to the antenna such that the metallic layer adjusts one or more operating parameters associated with the antenna during a wireless communication process associated with the vehicle electronic device (block 910). In some examples, the metallic layer(s) 710, 714 of FIGS. 7 and 8 are electrically coupled to one or more of the primary antenna(s) 106, 208, 210, 602 such that the metallic layer(s) 710, 714 adjust one or more operating parameter(s) associated with the primary antenna(s) 106, 208, 210, 602 during the first wireless communication process and/or the second wireless communication process. For example, when the vehicle electronic device 108 communicates with the trailer electronic device 112, the metallic layer(s) 710, 714 cause the signal range associated with the third primary antenna 602 to change (e.g., increase) while the metallic layer(s) 710, 714 are electrically coupled to the third primary antenna 602.

Although the example method 900 is described in connection with the flowchart of FIG. 9, other methods of providing the primary antenna(s) 106, 208, 210, 602 may alternatively be used. For example, the order of execution of the blocks 902, 904, 906, 908, 910 may be changed, and/or some of the blocks 902, 904, 906, 908, 910 described may be changed, eliminated, or combined.

As used herein, the terms "including" and "comprising" (and all forms and tenses thereof) are to be open ended terms. Thus, whenever a claim employs any form of "include" or "comprise" (e.g., comprises, includes, comprising, including, has, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended.

It will be appreciated that the systems, apparatus, and methods disclosed in the foregoing description provide numerous advantages. Examples disclosed herein provide a vehicle lamp and a vehicle antenna that is advantageously integrated into the vehicle lamp. Some disclosed examples provide a cost effective and/or efficient packaging solution for a vehicle lamp and antenna. Additionally, some disclosed examples enhance antenna performance by utilizing at least a stylized component of the vehicle lamp.

Although certain example systems, apparatus, and methods have been disclosed herein, the scope of coverage of this patent is not limited thereto. Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

What is claimed is:

1. A communication system a vehicle and a trailer, comprising:

a lamp positioned on the vehicle, the lamp including a stylized component including an exterior surface and an interior surface;

a conductive structure coupled to the interior surface of the stylized component of the lamp;

a primary antenna at least partially formed by the conductive structure and electrically coupled to a vehicle electronic device; and a secondary antenna positioned on the trailer and electrically coupled to a trailer electronic device, wherein the primary and secondary antennas, together, are configured to provide wireless communication between the vehicle and trailer electronic devices, wherein the stylized component includes a bezel or a lens, and the lamp includes a housing to which the stylized component is supported, and wherein the primary antenna is disposed on the interior surface of the stylized component.

2. The communication system of claim 1, wherein the lamp is a rear combination lamp or a back door mounted rear lamp adjacent the trailer.

3. The communication system of claim 1, wherein the stylized component includes a surface defining a cavity in which the primary antenna is positioned.

4. The communication system of claim 1, wherein the primary antenna is external to a housing of the lamp.

5. The communication system of claim 4, wherein the primary antenna is electrically coupled to antenna circuitry that is positioned in the housing of the lamp.

6. The communication system of claim 1, wherein the conductive structure includes one or more conductive traces at least partially covering a substrate of the stylized component.

7. The communication system of claim 1, wherein the conductive structure includes one or more metal plates at least partially covering a substrate of the stylized component.

8. The communication system of claim 1, wherein the conductive structure defines a metallization pattern exposing a transparent surface of the stylized component, light emitted from a light source of the lamp passing through the transparent surface and the conductive structure to provide a light pattern visible to a person external to the vehicle.

9. The communication system of claim 8, wherein the metallization pattern includes one of a zigzag pattern, a hatching pattern, a honeycomb pattern, or a stripe pattern.

10. The communication system of claim 1, wherein the trailer electronic device includes a camera positioned on a back door of the trailer.

11. The communication system of claim 1, wherein the conductive structure is configured to convert (a) a first electric current applied to the conductive structure into a first wireless signal receivable by the secondary antenna or (b) a second wireless signal received by the conductive structure into a second electric current for processing by the vehicle electronic device.

12. The communication system of claim 1, further including a wire harness electrically coupling the lamp and the primary antenna to a wiring system of the vehicle.

13. A vehicle lamp, comprising:

a housing;

a stylized component supported by the housing, the stylized component including a substrate with an exterior surface and an interior surface facing a light source of the lamp, and a metallic layer that covers the interior surface of the substrate of the stylized component;

a primary antenna supported by the housing and electrically coupled to a vehicle electronic device and the metallic layer, the primary antenna configured to electromagnetically interact with a secondary antenna external to the vehicle lamp, the metallic layer configured to increase a signal range of the primary antenna during a wireless communication process associated with the vehicle electronic device, wherein the stylized component includes a bezel or a lens, and the lamp includes a housing to which the stylized component is supported.

14. A method of providing an antenna for a vehicle electronic device, comprising:

forming a stylized component of a vehicle lamp, the stylized component including a substrate including an exterior surface and an interior surface;

coupling a metallic layer to the interior surface of the substrate of the stylized component;

mounting the antenna on a portion of the vehicle lamp; and electrically coupling the metallic layer to the antenna such that the metallic layer increases a signal range of the antenna during a wireless communication process associated with the vehicle electronic device, wherein the stylized component includes a bezel or a lens, and the lamp includes a housing to which the stylized component is supported.

15. The method of claim 14, further including forming, via a laser etching process, a pattern in the metallic layer exposing an area of the substrate that is transparent.

16. The method of claim 14, further including embedding the antenna in a portion of the stylized component.

* * * * *